United States Patent [19]

Sabev et al.

[11] Patent Number: 4,667,698

[45] Date of Patent: May 26, 1987

[54] HYDRAULIC DISTRIBUTOR

[75] Inventors: Sabi G. Sabev; Stefan D. Lasarov; Dimiter B. Todorov, all of Sofia; Darina K. Koparanova; Ivan B. Hristov, both of Kazanlik, all of Bulgaria

[73] Assignee: V M E I "LENIN", Sofia, Bulgaria

[21] Appl. No.: 788,076

[22] Filed: Oct. 16, 1985

[51] Int. Cl.[4] ..... F15B 13/04

[52] U.S. Cl. ..... 137/596.13; 91/445; 91/447; 137/596.2

[58] Field of Search ..... 91/445, 447; 137/596.13, 596.2

[56] References Cited

U.S. PATENT DOCUMENTS 2,572,705 10/1951 Edman ..... 91/445 X
3,216,448 11/1965 Stacey ..... 137/596.2
3,854,499 12/1974 Sievenpiper ..... 137/596.2
4,209,031 6/1980 Sutton ..... 137/106

*Primary Examiner*—Gerald A. Michalsky

[57] ABSTRACT

A hydraulic distributor in the body of which there is provided a central hole and supply, a discharge, a working, and bypass conduits, said conduits being connected to the central hole. In central hole there is disposed a plunger which is provided with central and end rings. Between the rings there are shaped profile necks and in one of the ends of the plungers there is provided a bypass groove. The working conduits are arranged perpendicularly to the central hole in the distributor body, and non-return valves are disposed in them. The spaces formed by the profile necks in the walls of the central hole are interconnected by an auxiliary conduit. In one embodiment of the distributor, the auxliary conduit is provided in the central ring of the plunger. In another embodiment of the distributor, the auxiliary conduit is provided in the body of the distributor.

2 Claims, 4 Drawing Figures

FIG. 2
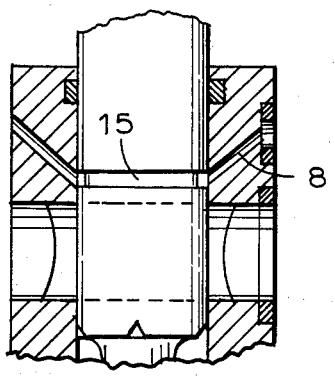
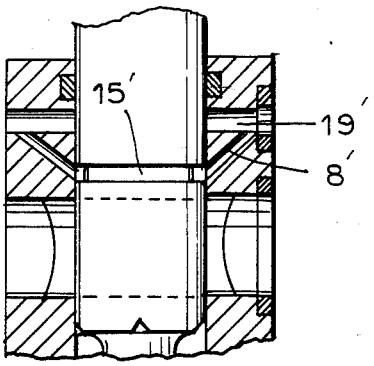
FIG. 4

HYDRAULIC DISTRIBUTOR

This invention relates to a hydraulic distributor designed for building, road-building, material-handling machines and, particularly, for electric and internal-combustion-engine high-lift industrial trucks.

A known hydraulic distributor, disclosed in the U.S. patent to Sutton, U.S. Pat. No. 4,209,031, comprises a body in which there are machined a central hole, supply, a discharge, and working and bypass conduits, all connected to the central hole. In the central hole there is disposed a plunger which is provided externally with central rings, end rings, profile necks, and bypass grooves, equal in number to in number to the bypass conduits in the body. In the plunger there is machined a stepped axial hole, in which a small piston is disposed. In the wall, formed between the stepped hole and the external surface of the plunger, there is machined an elongated slot. In one of the working conduits, there is disposed a non-return valve, controlled by a rod, which disposed perpendicularly to the plunger, so that the one end of the rod enters in the elongated slot in the plunger in front of the small piston, while the other end of the rod is connected to the non-return valve.

A drawback of the distributor lies in its design and technological complexity, as well as in the necessity of supplying a pressure for opening the non-return valve during the whole duration of the respective operation, such as the lowering of the load by high-lift trucks; this results in an increase in energy consumption.

It is, therefore, the general object of this invention to provide a hydraulic distributor of simplified design which is adaptable to easy manufacture, in which only a small force is applied for the opening of the non-return valves, thus reducing the energy consumption, particularly during the lowering the load by high-lift trucks.

These objects are achieved by a hydraulic distributor in accordance with the invention in the body of which there are machined a central hole, a supply, a discharge, working and bypass conduits connected to the central hole. In the central hole there is disposed a plunger which is provided with central and end rings, between which there are shaped profile necks, and in one of its ends there is machined a bypass groove. The working conduits are arranged perpendicularly to the central hole, and non-return valves are mounted in them. According to the invention, the spaces formed by the profile necks in the wall of the central hole are interconnected by an auxiliary conduit. In one preferred embodiment, the auxiliary conduit is machined in the central ring of the plunger. In another preferred embodiment, the auxiliary conduit is machined in the body of the distributor. The advantage of the invention lies in that the design of the distributor is simplified and well adapted to economical manufacture, while its actuation is effected with a small force at a low energy consumption, particularly during the lowering of the load by high-lift trucks.

For a better understanding of the invention, reference should be made to the accompanying drawings, in which there are illustrated and described preferred embodiments of the invention. In the drawings:

FIG. 2 is a transverse sectional view taken along the line 2—2 in FIG. 1;

FIG. 4 is a transverse view taken along the line 4—4 in FIG. 3.

Figure 1:
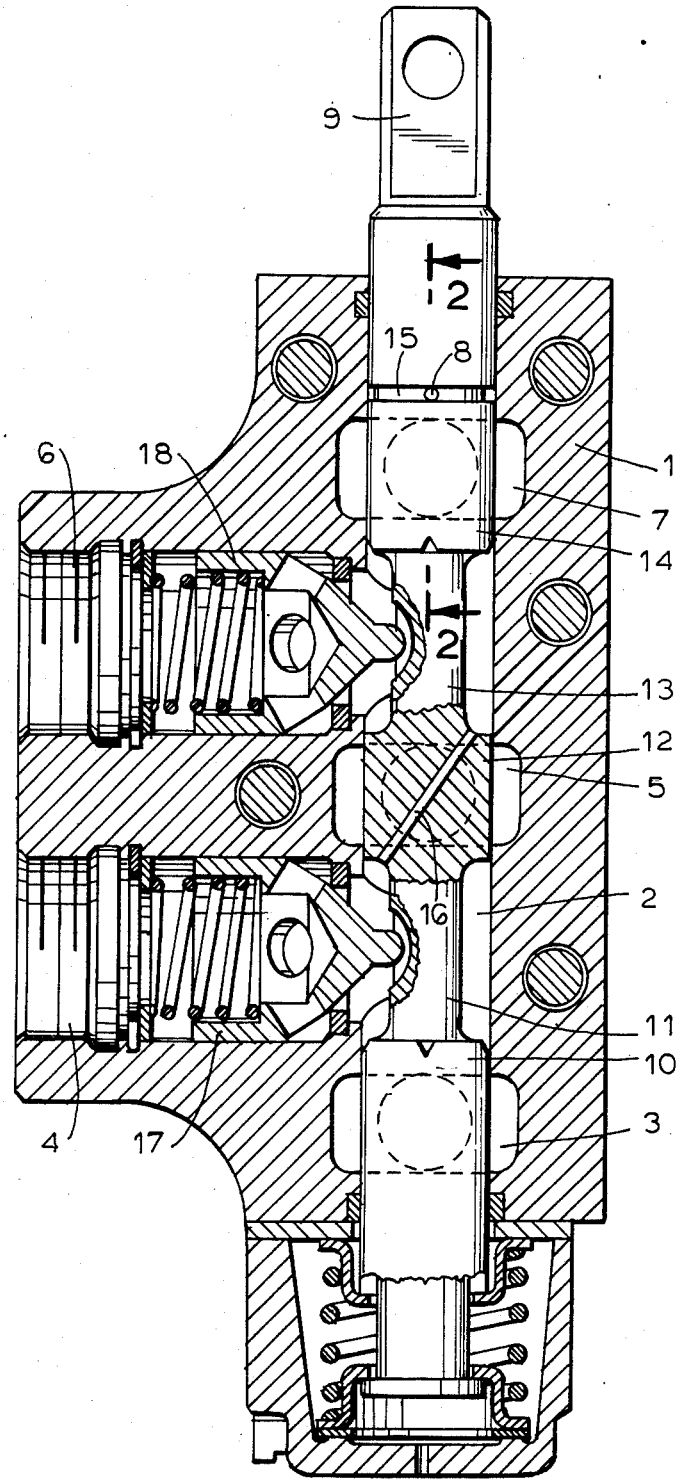
FIG. 1 is a longitudinal sectional view of a first embodiment of the invention, such embodiment being a hydraulic distributor constructed as a double-acting (four-way, three-position) section.

Turning first to the embodiment of FIGS. 1 and 2, in the double-acting section of the body 1 of the distributor, there is machined a central hole 2, said hole 2 being connected in succession with a first discharge conduit 3, a first working conduit 4, a supply conduit 5, a second working conduit 6, a second discharge conduit 7, and a bypass conduit 8. In the central hole 2, there is disposed a plunger 9 on which there are machined in succession a first end ring 10, a first profile neck 11, a central ring 12, a second profile neck 13, a second end ring 14, and a bypass groove 15. In the center ring 12, there is bored an auxiliary conduit 16 which connects the spaces of the first profile neck 11 and the second profile neck 13. Two non-return vales 17 and 18 are mounted in the working conduits 4 and 6, respectively, of the body 1. When the plunger 9 is in neutral (non-actuated) position, the bypass conduit 8 is connected to the bypass groove 15, the discharge conduits 3 and 7 are covered by both end rings 10 and 14, the supply conduit 5 is covered by the central ring 12, while the profile necks 11 and 14 are arranged axially-symmetrically to the axes of the working conduits 4 and 6.

The embodiment of hydraulic distributor shown in FIGS. 1 and 2 operates as follows. When the plunger 9 is in neutral position, the working fluid of the pump (not shown) of the hydraulic system returns into the reservoir via by the bypass conduit 8, which is uncovered by the bypass groove 15. Working conduits 4 and 6 are connected with the working spaces of a hydraulic motor (not shown) controlled by the hydraulic distributor, conduits 4 and 6 are closed hermetrically by the non-return valves 17 and 18.

When actuating the plunger 9 upwardly from its neutral position, for example, the bypass conduit 8 is covered because of the displacement of the bypass groove 15, and the working fluid is supplied from the pump via the supply conduit 5 to the first working conduit 4 through the non-return valve 17. At the same time, the pressure of the pump is supplied by the auxiliary conduit 16 into the second working conduit and, as a result, the non-valve 18 is balanced hydraulically and can easily be opened mechanically. The opening and the retention of the non-return valve 18 in its open position is effected mechanically by the plunger 9 by means of the profile neck 13. At the same time the second end ring 14 of the plunger 9 uncovers a second discharge conduit 7. The working fluid of the pump is supplied via the supply conduit 5 and the non-return valve 17 to one of the working spaces of the hydraulic motor (not shown), while the fluid from its other space returns via the non-return valve 18 and the second discharge conduit 7 to the reservoir. A working motion is effected, in which only a minimum portion of the pump output is lost, passing the auxiliary conduit 16 into the reservoir.

Figure 3:
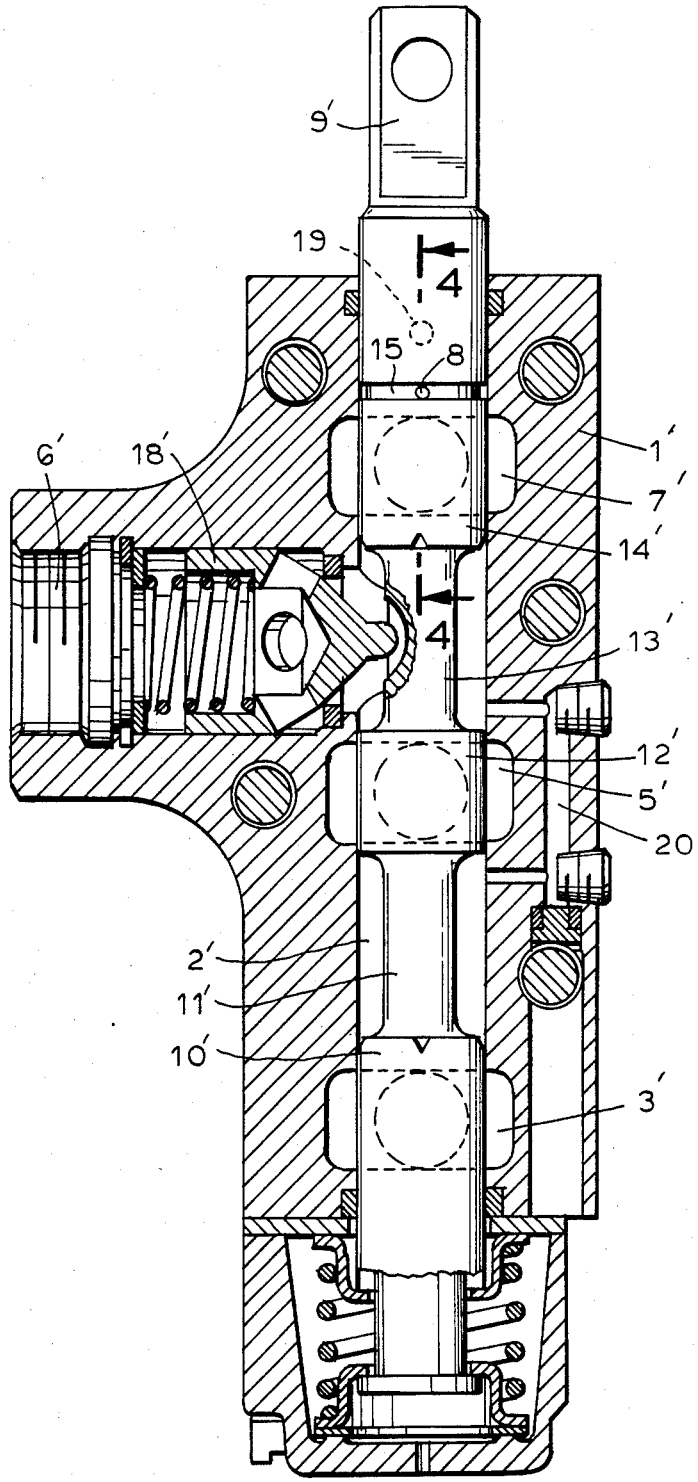
FIG. 3 is a longitudinal sectional view of a second embodiment in accordance with the invention, such second embodiment being a hydraulic distributor constructed as a single-acting (three-way, three-position) section.

Turning now to the second embodiment, shown in FIGS. 3 and 4, parts thereof which are similar to those in the first embodiment of FIGS. 1 and 2 are designated by the same reference characters with an added prime. In the single-acting section, the hydraulic distributor has only one working conduit 6', in which there is disposed a non-return valve 18'. A second bypass conduit 19 is machined in the body of 1' of the distributor above the bypass conduit 8, and in the region of the central ring 12' is made an auxiliary conduit 20, which connects the spaces of both profile necks 11' and 13' on both sides of the central ring 12' of the plunger 9' when the latter in neutral position.

When the plunger 9' is in its neutral position, the working fluid from the pump returns via the bypass conduit 8' into the reservoir. The working conduit 6', connected to the working space of the hydraulic motor, is closed hermetrically by the non-return valve 18'.

When the plunger 9' is actuated downwardly from its neutral position, for example, the bypass conduit 8' is covered, and then the working fluid of the pump is supplied by the supply conduit 5' to the working conduit 6' and opens the non-return valve 18'. The central ring 12' of the plunger 9' covers the auxiliary conduit 20 before the end ring 10' has opened the first discharge conduit 3', so that the whole throughput of the pump is supplied to the operating space of the hydraulic motor.

When the plunger 9' is actuated upwardly from its neutral position, for example, the bypass conduit 8' is closed, and then the pressure of pump is supplied to the working conduit 6' via the supply conduit 5' and the auxiliary conduit 20 and, as a result, the non-return valve 18 is balanced hydraulically and can be easily opened mechanically. The opening and the retention of the non-return valve 18' in open position is effected mechanically by the plunger 9' by means of the profile neck 13', and the second end ring 14' of the plunger 9' opens the second discharge conduit 7' and the working fluid of the working space of the hydraulic motor returns via the non-return valve 18' and the second discharge conduit 7' into the reservoir. At the the same time, the bypass 15 uncovers the second bypass conduit 19 and working fluid of the pump also returns the reservoir.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A hydraulic distributor, comprising a body in which there is a central hole, a supply, a discharge, and working conduits and bypass conduits, all connected with the central hole in which there is disposed a plunger with central and end rings, between which there are, shaped profile necks, and in one end of the plunger there is a bypass groove, the working conduits being arranged perpendicularly to the central hole in the body of the distributor, in the working conduits, there are mounted non-return valves, the spaces formed by the profile necks of the plunger and the wall of the central hole in the body of the distributor being interconnected by means of an auxiliary conduit, said auxiliary conduit is machined therein so that when the plunger is in a neutral inactive position the auxiliary conduit is connected only to the spaces formed by the profile necks, the wall of the central hole and the non-return valves.

2. A hydraulic distributor comprising

A body in which there is a central hole, a supply, a discharge, and working conduits and bypass conduits, all connected with the central hole in which there is disposed a plunger with central and end rings, between which there are, shaped profile necks, and in one end of the plunger there is a bypass groove, the working conduits being arranged perpendicularly to the central hole in the body of the distributor, in the working conduits, there are mounted non-return valves, the spaces formed by the profile necks of the plunger and the wall of the central hole in the body of the distributor being interconnected by means of an auxiliary conduit, wherein the auxiliary conduit is disposed in the central ring of the plunger.

* * * * *